US010830429B2

(12) United States Patent
Duckworth et al.

(10) Patent No.: US 10,830,429 B2
(45) Date of Patent: Nov. 10, 2020

(54) LUMINAIRE HOUSING

(71) Applicant: Hubbell Incorporated, Shelton, CT (US)

(72) Inventors: Jason E. Duckworth, Simpsonville, SC (US); Mark V. Elmore, Easley, SC (US); Douglas S. Hodges, Anderson, SC (US)

(73) Assignee: Hubbell Incorporated, Shelton, CT (US)

( * ) Notice: Subject to any disclaimer, the term of this patent is extended or adjusted under 35 U.S.C. 154(b) by 679 days.

(21) Appl. No.: 14/984,827

(22) Filed: Dec. 30, 2015

(65) Prior Publication Data

US 2016/0305643 A1 Oct. 20, 2016

Related U.S. Application Data

(60) Provisional application No. 62/148,118, filed on Apr. 15, 2015.

(51) Int. Cl.

| | |
|---|---|
| ***F21V 29/75*** | (2015.01) |
| ***F21V 23/00*** | (2015.01) |
| ***F21V 15/01*** | (2006.01) |
| ***F21V 29/76*** | (2015.01) |
| ***F21V 29/83*** | (2015.01) |
| ***F21S 8/00*** | (2006.01) |
| ***F21V 19/00*** | (2006.01) |
| *F21Y 105/10* | (2016.01) |
| *F21Y 115/10* | (2016.01) |

(52) U.S. Cl.

CPC ..... *F21V 29/75* (2015.01); *F21S 8/033* (2013.01); *F21V 15/01* (2013.01); *F21V 19/003* (2013.01); *F21V 23/008* (2013.01); *F21V 29/763* (2015.01); *F21V 29/83* (2015.01); *F21Y 2105/10* (2016.08); *F21Y 2115/10* (2016.08)

(58) Field of Classification Search

CPC ..... F21V 29/75; F21V 19/003; F21V 29/83; F21V 23/008

See application file for complete search history.

(56) References Cited

U.S. PATENT DOCUMENTS

| | | | | |
|---|---|---|---|---|
| 8,419,217 | B2 | 4/2013 | Lu et al. | |
| 8,814,398 | B2 | 8/2014 | Kang et al. | |
| 2012/0087118 | A1 | 4/2012 | Bailey et al. | |
| 2012/0250311 | A1* | 10/2012 | Luegge | F21V 31/005 362/235 |
| 2012/0325982 | A1* | 12/2012 | Guercio | F21V 31/005 248/65 |

(Continued)

FOREIGN PATENT DOCUMENTS

| | | |
|---|---|---|
| EP | 2187121 | 12/2014 |

OTHER PUBLICATIONS

PCT/US2016/027067 International Search Report and Written Opinion dated Sep. 6, 2016 (13 pages).

*Primary Examiner* — Karabi Guharay

(74) *Attorney, Agent, or Firm* — Michael Best & Friedrich, LLP

(57) ABSTRACT

A luminaire having a housing, a control assembly positioned in the housing, a cover connected to the housing, and a light emitter. Different covers, control components, and light emitters can be used with the luminaire to create a desired appearance and light output.

20 Claims, 11 Drawing Sheets

(56) References Cited

U.S. PATENT DOCUMENTS

| | | | | |
|---|---|---|---|---|
| 2013/0049591 | A1* | 2/2013 | Quercia | F21V 17/06 315/86 |
| 2013/0329405 | A1* | 12/2013 | Chow | F21S 8/02 362/147 |
| 2014/0085902 | A1 | 3/2014 | Higuchi et al. | |
| 2014/0184050 | A1* | 7/2014 | Mizuta | F21V 29/717 313/35 |
| 2015/0345772 | A1 | 12/2015 | Duckworth et al. | |

* cited by examiner

LUMINAIRE HOUSING

RELATED APPLICATION(S)

This application is based on U.S. provisional application Ser. No. 62/148,118, filed Apr. 15, 2015, the disclosure of which is incorporated herein by reference in its entirety and to which priority is claimed.

FIELD

Various exemplary embodiments relate to luminaires and components for luminaires.

BACKGROUND

Light fixtures, or luminaires, are used with electric light sources to provide an aesthetic and functional housing in both interior and exterior applications. One type of light fixture is an area light, generally used for exterior lighting of buildings, walkways, parks, and parking lots, and interior applications such as hallways, warehouses, entryways, or other areas. Area lights typically include a light fixture attached to a pole, wall, or other elevated structure to provide an elevated lighting position. In recent years, lighting applications, including area lights have trended towards the use of light emitting diodes (LEDs) as a light source in place of conventional incandescent and fluorescent lamps.

SUMMARY

According to an exemplary embodiment, a luminaire includes a base, a light support, a first set of fins, and a second set of fins. The light support extends from the base and includes a mounting section. The first set of fins is in thermal communication with the mounting section. The second set of fins intersects the first set of fins and is in thermal communication with the mounting section.

According to another exemplary embodiment, a luminaire includes a control assembly positioned in a housing. A cover is connected to the housing having a mounting section and a chamber including a heat fin in thermal communication with the mounting section. A light assembly is connected to the mounting section and operatively connected to the control assembly.

According to another exemplary embodiment, a luminaire includes a control assembly positioned in a housing. A cover is connected to the housing. A light assembly is operatively connected to the control assembly. A mounting assembly includes a mounting plate connectable to a surface and a mounting bracket connected to the housing.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Various exemplary embodiments of this application are directed to luminaires, for example indoor and outdoor area lighting luminaires. The luminaires allow for mounting and housing of different components as required for different applications using similar elements. For example, common housings or mounting features can accommodate different configurations of luminaires that include one or more different types of light emitters, drivers, surge protectors, fuses, photocells, occupancy sensors, wireless communication devices, covers, and lenses. The luminaires also provide efficient thermal management across the range of configurations. This allows customers to customize the luminaire to a desired architectural design within the same product line.

An exemplary embodiment of a luminaire is shown in FIGS. 1-13 having a chassis 40 which includes a base 42 and a light support 44 extending from the base 42. The chassis 40 can be a monolithic or unitarily formed structure or it can be formed of separate pieces that are attached together.

Different materials can be used to form the chassis 40 including metals, for example aluminum, polymers, and/or composite materials. The chassis 40 can be molded, cast, machined, or formed by any other suitable process.

Figure 3:
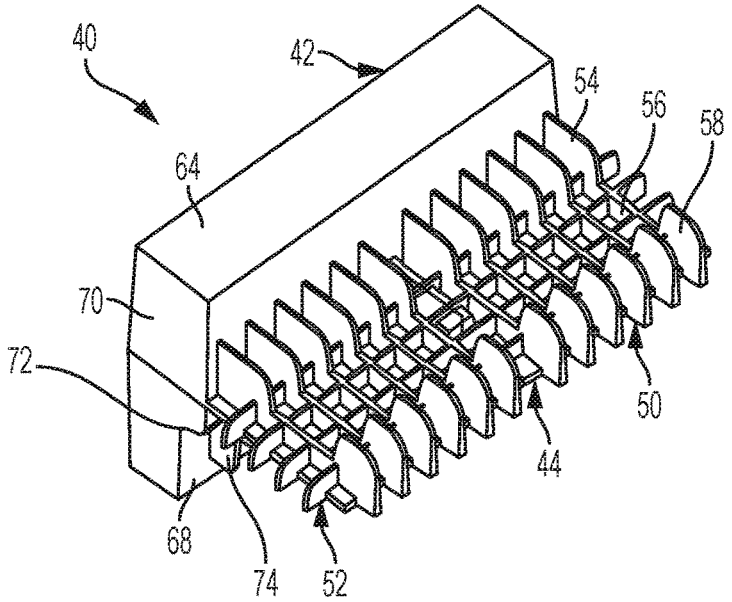
FIG. 3 is a top perspective view of FIG. 1.
Figure 4:
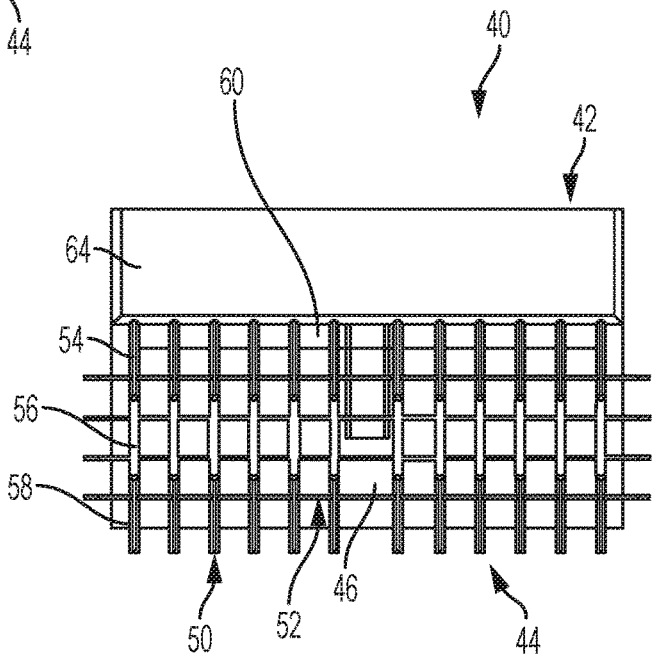
FIG. 4 is a top view of FIG. 1.
Figure 5:
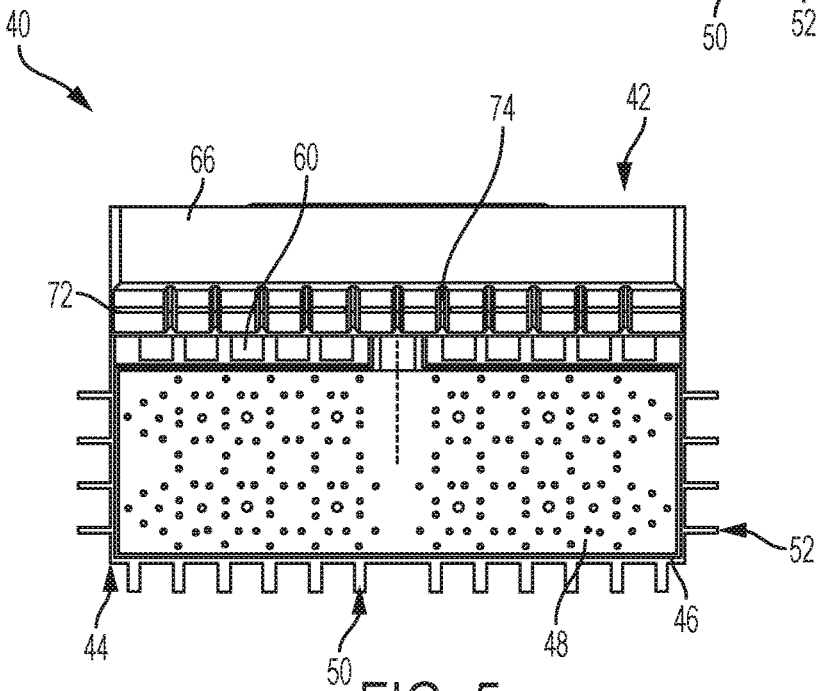
FIG. 5 is a bottom view of FIG. 1.

As best shown in FIGS. 3-5, the light support 44 extends outwardly from the base 42. The light support 44 can be substantially perpendicular to the base 42 or at an oblique angle depending on the overall configuration and the direction of the desired light output. The light support 44 includes a mounting section 46. In an exemplary embodiment, the mounting section 46 is configured to receive and LED board 48 which includes a printed circuit board (PCB) and one or more light emitters, for example light emitting diodes (LEDs). The light support 44 can also be configured to support other types of LED modules or other light sources.

The top surface of the light support includes a plurality of fins. In an exemplary embodiment, a plurality of first fins 50 extends outwardly from the base and a plurality of second fins 52 extend orthogonal to the first fins 50, although other angles and configurations of the first and second fins 50, 52 may be used.

The first fins 50 include a first section 54, a second section 56, and a third section 58. The first section 54 extends outwardly from the base 42, either in contact with the base 42 or spaced therefrom. The first section 54 includes a curved edge that transitions to the second section 56. The second section 56 extends between, and is spaced below, the first and the third sections 54, 58. The third section 58 extends from the second section 56 and has a pair of rounded edges. In an exemplary embodiment, at least a portion of the third section 58 extends beyond the mounting section 46. In certain exemplary embodiments, the LED board 48 is configured so that one or more LEDs are positioned substantially directly beneath one of the first fins 50. For example, rows of LEDs can be aligned with the first set of fins 50 and/or the second set of fins 52. The size, shape, length, and spacing of the first fins 50 can vary depending on the characteristics of the base and the components of the luminaire.

The second fins 52 extend across the first fins 50. The second fins 52 can include rounded corners, for example at a first end and a second end. In an exemplary embodiment, at least one of the second fins 52 extends beyond the mounting section 46 on a first and second side. The size, shape, length, and spacing of the second fins 52 can vary depending on the characteristics of the base and the components of the luminaire.

In an exemplary embodiment, one or more gaps 60 are formed between the base 42 and the mounting section 46. The first fins 50 extending from the base 42 can separate individual gaps 60. The gaps 60 allow for better air circulation and, in combination with the fins 50, 52, provide increased heat transfer to draw heat from the light emitters to the surrounding environment.

Figure 1:
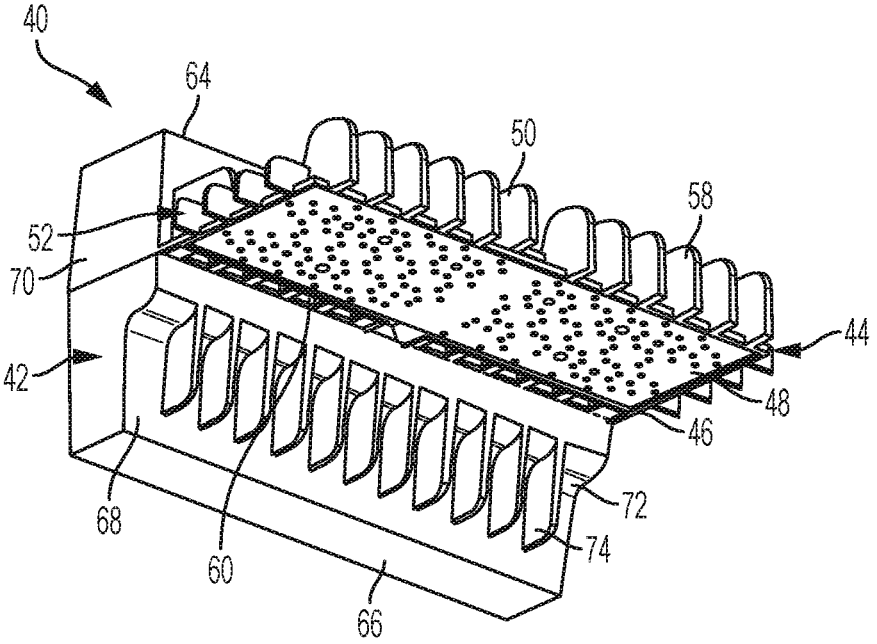
FIG. 1 is a bottom perspective view of an exemplary luminaire chassis.
Figure 2:
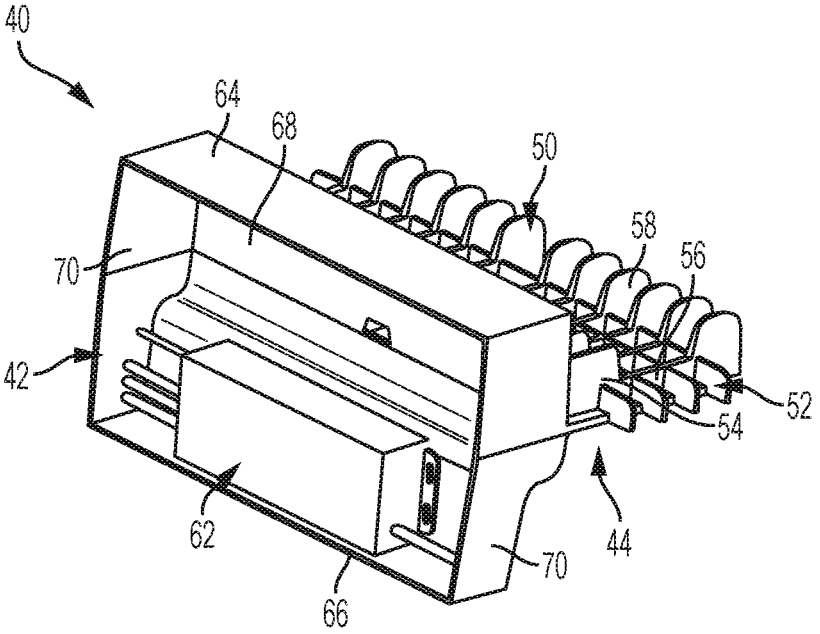
FIG. 2 is a rear perspective view of FIG. 1.

As best shown in FIG. 2, the base 42 can acts as a housing or enclosure for various control components 62. For example, different drivers, surge protectors, photocells, occupancy sensors, and/or wireless communication devices can be housed in the base 42. The base 42 includes a top wall 64, a bottom wall 66, a front wall 68, and one or more side walls 70 to define a chamber or enclosed area. Although the base 42 is shown as open, another wall can partially or entirely enclose the chamber. The front and side walls 68, 70 include a top section and a bottom section. The bottom section is narrower than the top section. A curved transition 72 is provided between the top and bottom sections, although other configurations can be used. A third set of fins 74 extend from the front wall 68, for example extending downwardly from the top section and outwardly from the bottom section. The size, shape, length, and spacing of the third fins 74 can vary depending on the characteristics of the base 42 and the components of the luminaire.

Figure 6:
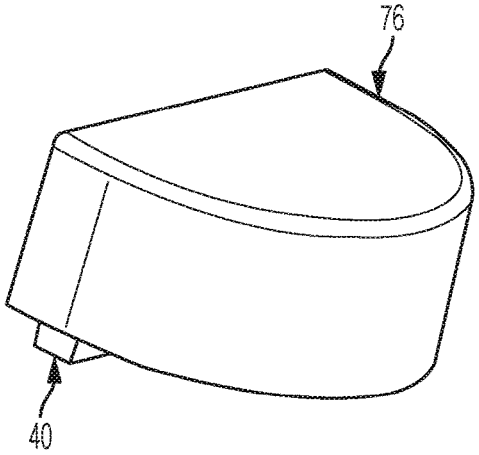
FIG. 6 is a top perspective view of the exemplary luminaire chassis including an exemplary cover.
Figure 7:
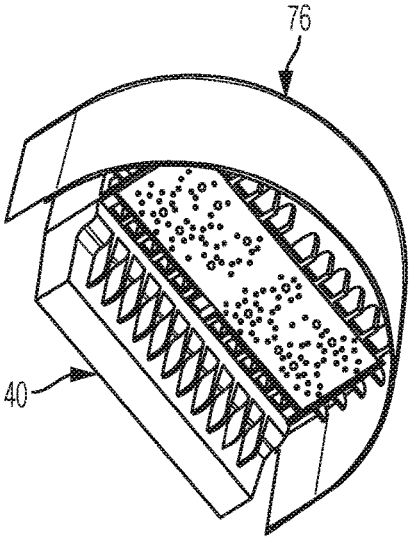
FIG. 7 is a bottom perspective view of FIG. 6.
Figure 8:
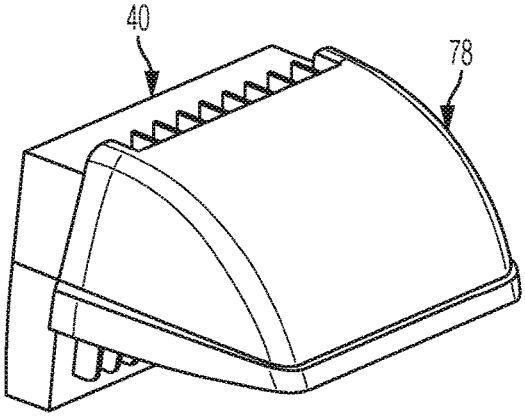
FIG. 8 is a top perspective view of the exemplary luminaire chassis including another exemplary cover.
Figure 9:
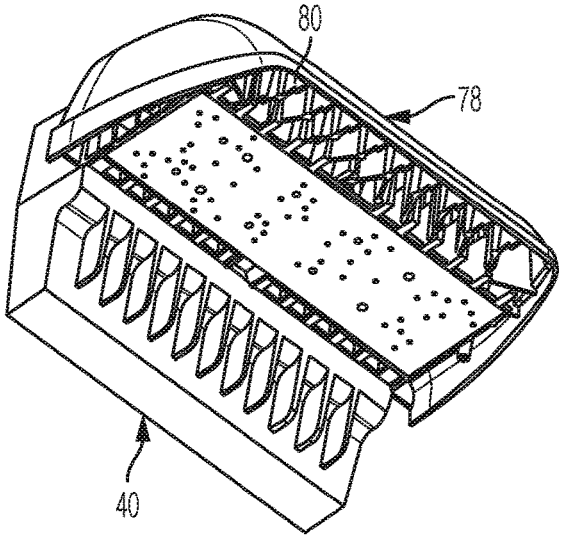
FIG. 9 is a bottom perspective view of FIG. 8.
Figure 10:
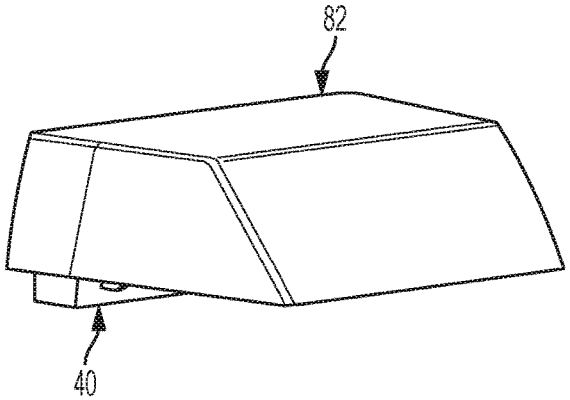
FIG. 10 is a top perspective view of the exemplary luminaire chassis including another exemplary cover.
Figure 11:
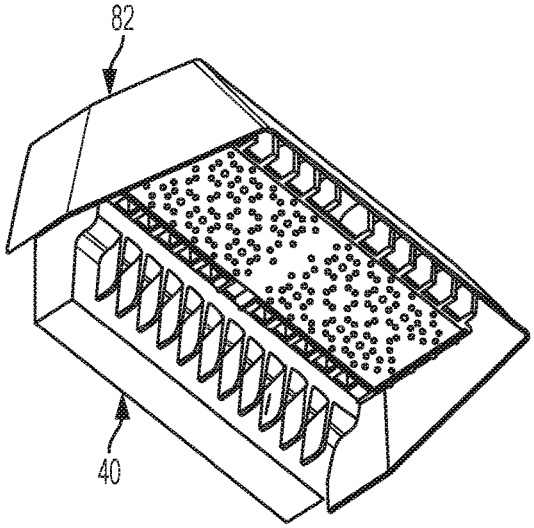
FIG. 11 is bottom perspective view of FIG. 10.
Figure 12:
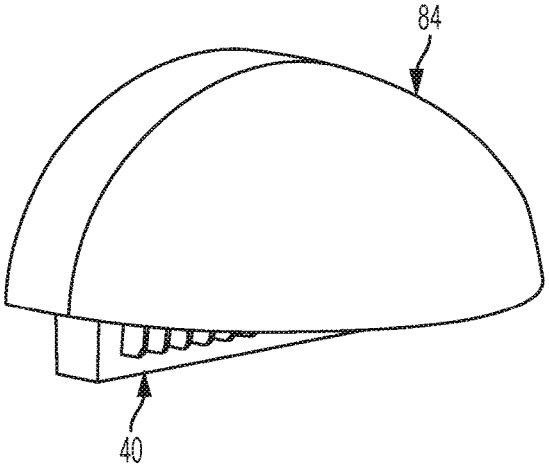
FIG. 12 is a top perspective view of the exemplary luminaire chassis including a first exemplary cover.
Figure 13:
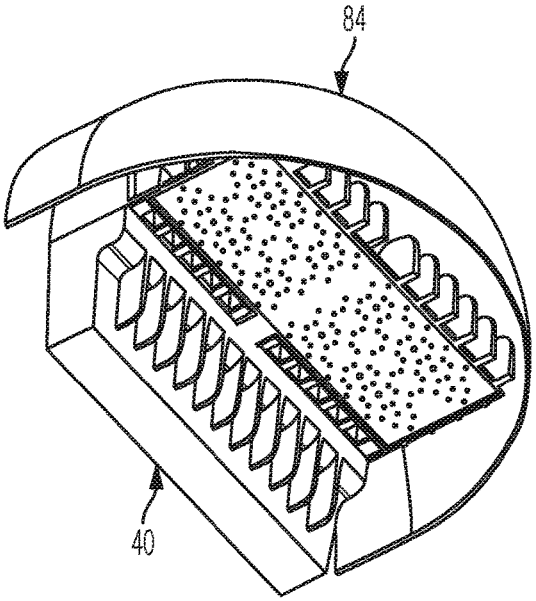
FIG. 13 is a bottom perspective view of FIG. 12.
Figure 14:
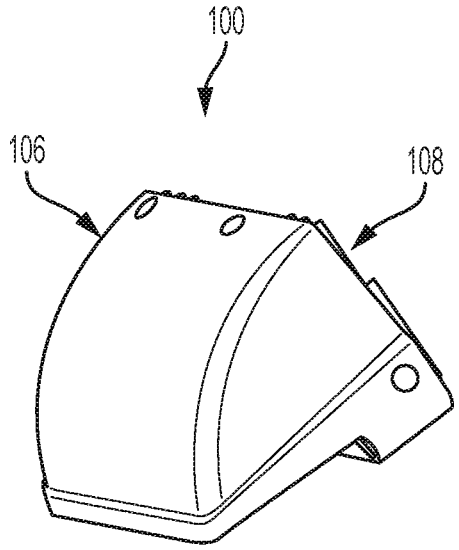
FIG. 14 is a top perspective view of another exemplary luminaire.
Figure 15:
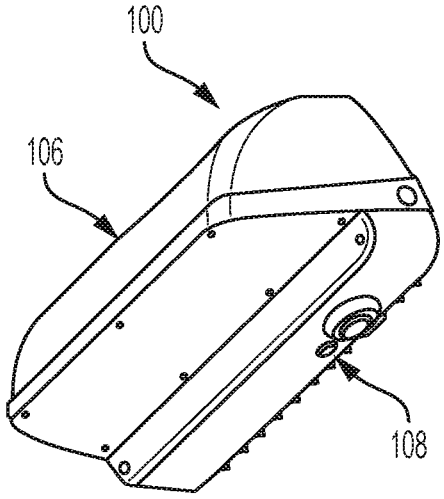
FIG. 15 is a bottom perspective view of FIG. 14.
Figure 16:
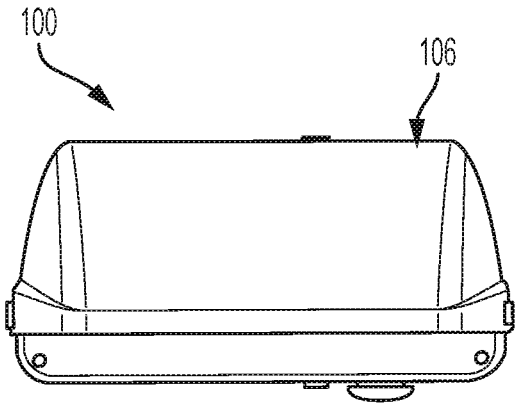
FIG. 16 is a front view of FIG. 14.
Figure 17:
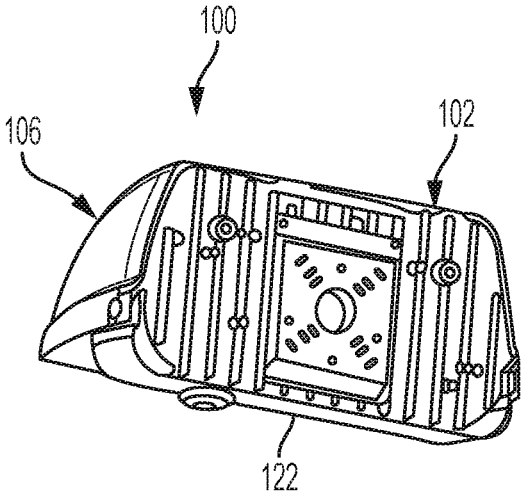
FIG. 17 is a rear perspective view of FIG. 14.
Figure 18:
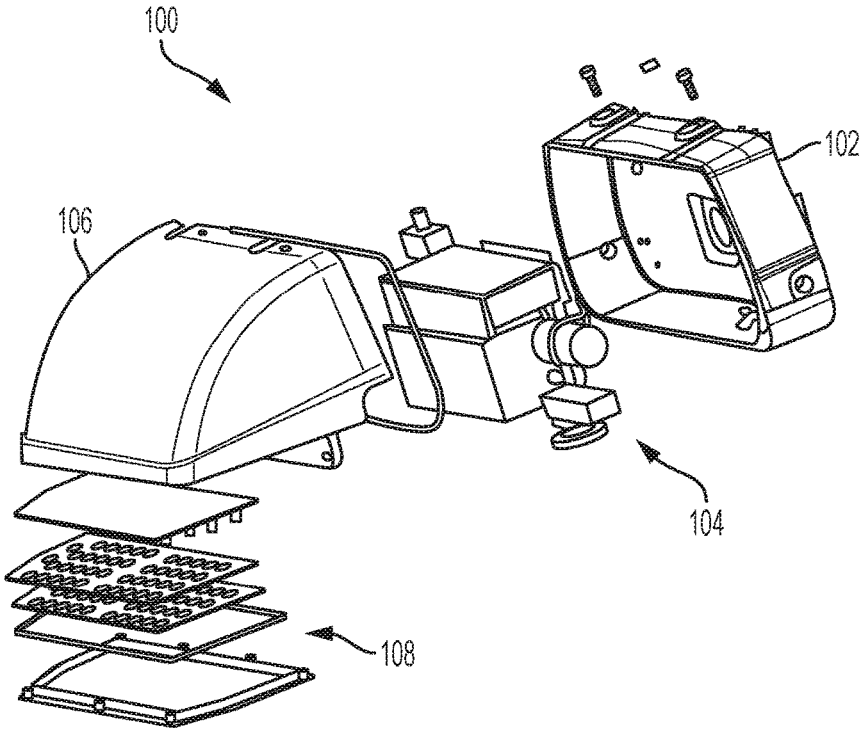
FIG. 18 is an exploded view of FIG. 14.

In various exemplary embodiments, different covers can be connected to the chassis 40 to be positioned over and/or to at least partially enclose the light support 44. FIGS. 6 and 7 show an exemplary radius cover 76 that includes a semi-circular cover with a rounded front edge and a flat top. FIGS. 8 and 9 show an exemplary LNC cover 78 that includes a curved top edge, rounded corners, and angled sides. Fins 80 can extend from the inside of the cover 78 to align with the fins 50, 52 of the light support. FIGS. 10 and 11 show an exemplary trapezoid cover 82 that includes angled side walls and a front wall that angles down and away from the light support 44. FIGS. 12 and 13 show an exemplary quarter sphere cover 84 that includes a partial dome. Lenses or other optics can be connected to the covers or the chassis to direct or diffuse light.

FIGS. 14-35 show another exemplary embodiment of a luminaire 100 having a housing 102, a control assembly 104, a cover 106, and a light assembly 108. The housing 102 and cover 106 can have a variety of shapes, sizes, and configurations and be made from a variety of materials including metals, polymers, composites, and other suitable materials. The housing 102 and the cover 106 are each shown as single-piece, unitary structures, although they can also be composed of multiple pieces that are connected together. The control assembly 104 can include a variety of different components, including any combination of drivers, surge protectors, fuses, photocells, occupancy sensors, and wireless communication devices. The light assembly 108 includes one or more light emitting devices.

Figure 19:
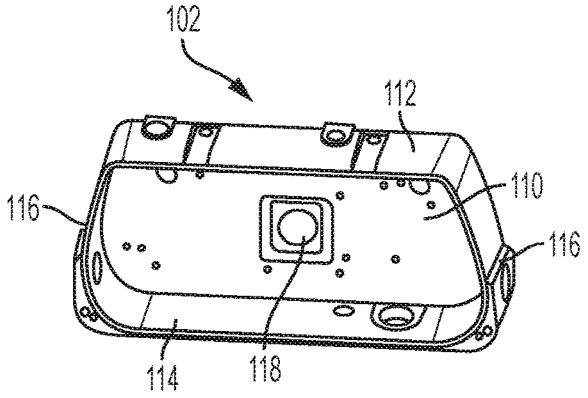
FIG. 19 is a front perspective view of an exemplary housing.
Figure 20:
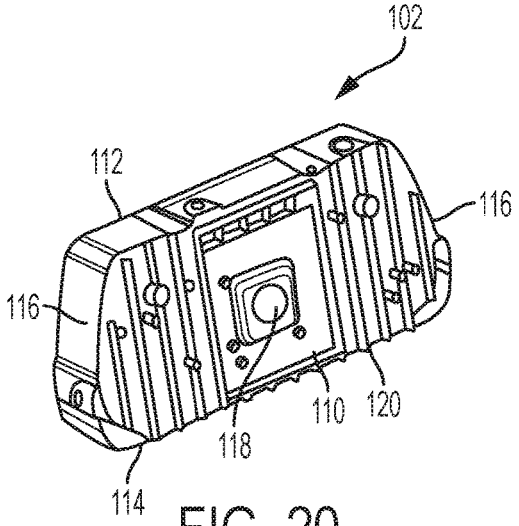
FIG. 20 is a rear perspective view of FIG. 19.

FIGS. 19 and 20 show an exemplary embodiment of a housing 102. The housing 102 has a back wall 110, a top wall 112, a bottom wall 114, and a pair of side walls 116 that surround a cavity. A number of openings are provided in the housing 102 to receive fasteners, seals, and components of the control assembly 104. A conductor opening 118 is provided in the back wall 110 and a recessed area is formed around the conductor opening 118. More than one conductor opening 118 can be provided in various locations on the housing 102. Knock-outs may be used to provide selective openings for conductors and other components. One or more fins 120 extend from the back wall 110 to increase the heat transfer from the housing 102.

Figure 21:
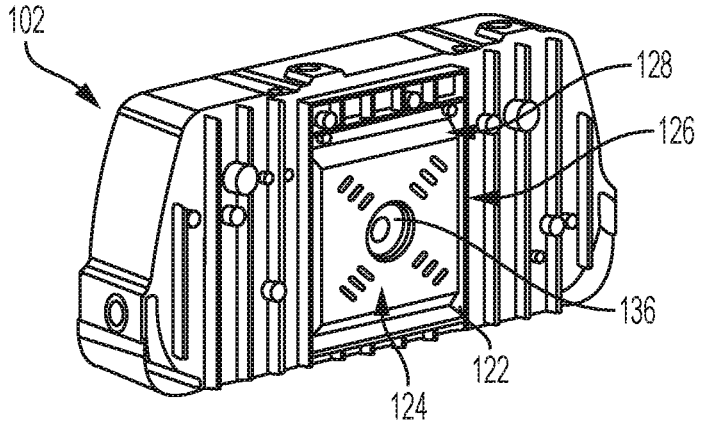
FIG. 21 is a rear perspective view of the exemplary housing of FIG. 19 and an exemplary mounting assembly.
Figure 22:
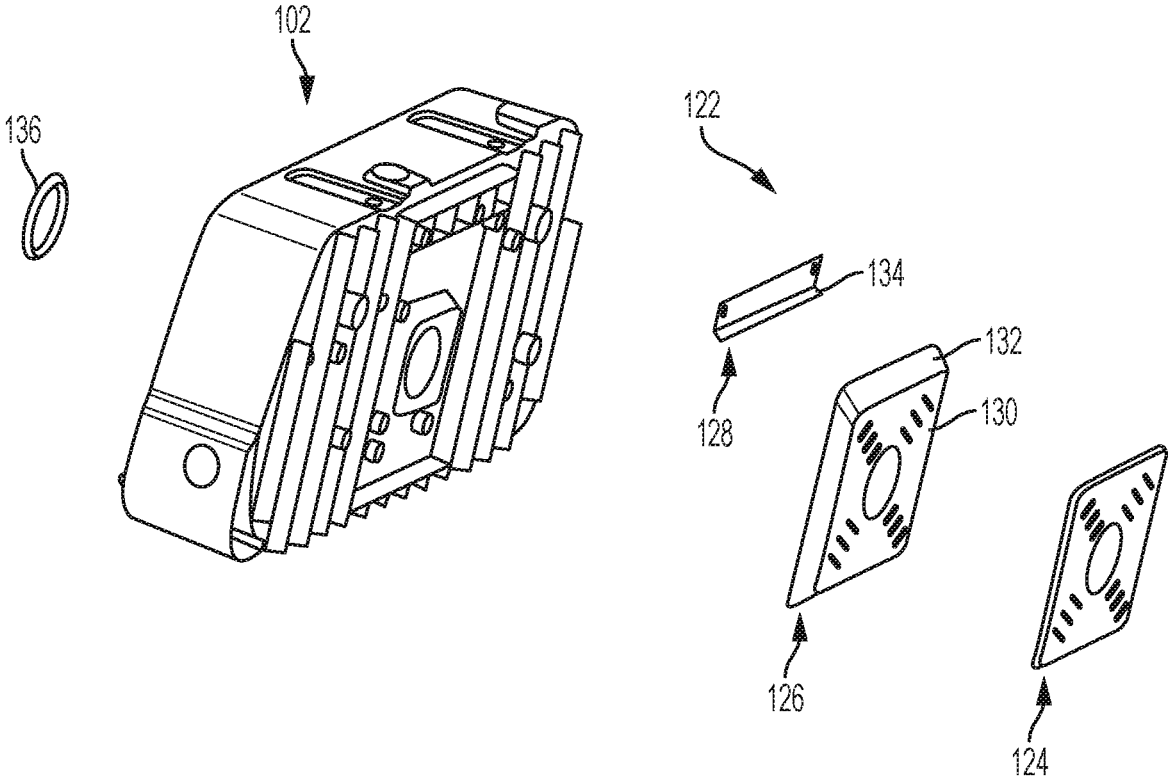
FIG. 22 is an exploded view of FIG. 22.

FIGS. 21 and 22 show an exemplary mounting assembly 122 associated with the housing 102 used to attach the luminaire 100 to a structure, for example a wall, post, or other type of support. The mounting assembly 122 includes a gasket 124, a mounting plate 126, and a mounting bracket 128. The mounting plate 126 and the gasket 124 include different openings to allow for different connections. The gasket 124 is placed against the structure and the mounting plate 126 is attached to the structure, for example through straps, bolts, screws, or other fasteners. The mounting bracket 128 is secured to the housing 102. The mounting plate 126 includes a base 130 and one or more angled walls 132 extending from the base 130. The mounting bracket 128 includes an angled tab 134 that engages the angled walls 132 of the mounting plate 126. After the mounting plate 126 is connected to a structure, the housing 102 can be positioned adjacent the mounting plate 126 and the angled tab 134 of the mounting bracket 128 can engage the angled wall 132 of the mounting plate 126. The angled surfaces allow the housing 102 to slide down onto the mounting plate 126, providing easier mounting and forming a close engagement with the structure. One or more set screws can be used to secure the mounting plate 126 to the mounting bracket 128.

As best shown in FIGS. 21 and 22, a conductor gasket 136 can be connected to the housing 102. The conductor gasket 136 is positioned in the recess in the housing 102 around the conductor opening 118. The conductor opening 118 aligns with openings on the mounting plate 126 and the gasket 124 so that conductors can be feed into the housing 102. The conductor gasket 136 protects the conductors from wear and can also prevent water from entering the housing 102.

A variety of components and configurations can be used in connection with the luminaire 100 as desired by a user. FIGS. 23-27 show exemplary embodiments of different control assemblies 104A-D that can be incorporated in the housing 102. Each of the exemplary control assemblies 104A-D can utilize a photo-detector 138 and a motion or occupancy sensor 140 positioned in and extending through the housing 102. Additional and alternative sensors can be used as would be understood by one of ordinary skill in the art.

Figure 23:
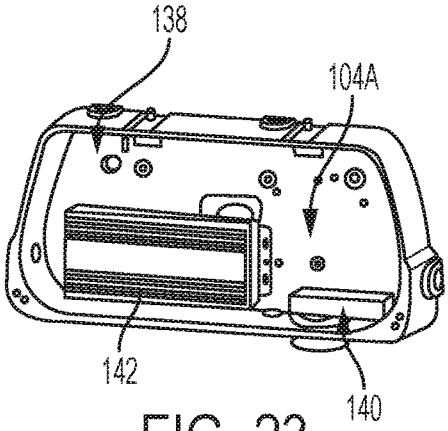
FIG. 23 is a front perspective view of a first exemplary control assembly positioned in the housing.
Figure 24:
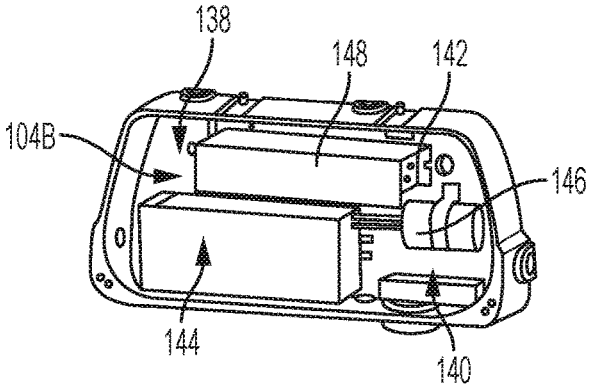
FIG. 24 is a front perspective view of a second exemplary control assembly positioned in the housing.
Figure 25:
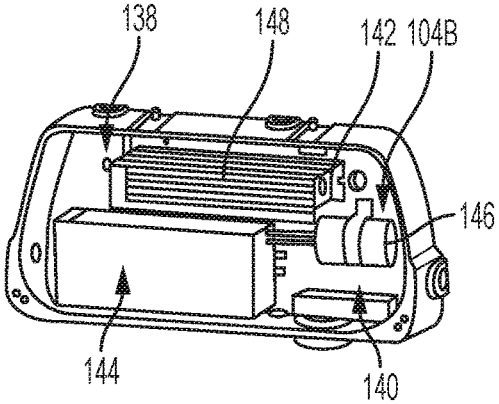
FIG. 25 is a front perspective view of the second exemplary control assembly with a bracket faded to show the attached driver.

FIGS. 23-25 show exemplary control assemblies 104A-B that utilize a single first driver 142. In an exemplary embodiment, the first driver 142 runs at approximately 1050 mA. In the first control assembly 104A, the first driver 142 is positioned so that a major surface is substantially parallel to the back wall of the housing 102. FIGS. 24 and 25 show a control assembly 104B that includes the first driver 142, a backup battery unit 144, and a surge protector 146. The backup battery unit 144 can include a housing, a rechargeable battery, and circuitry to control the charging and discharging of the battery. The first driver 142 is connected to a bracket 148 and is oriented so that a major surface is substantially perpendicular to the back wall of the housing 102. The surge protector 146 can be connected to the back battery unit 144 and/or the driver 142. The backup battery unit 144 and the surge protector 146 can also be incorporated into any of the other control assemblies 104C-D.

Figure 26:
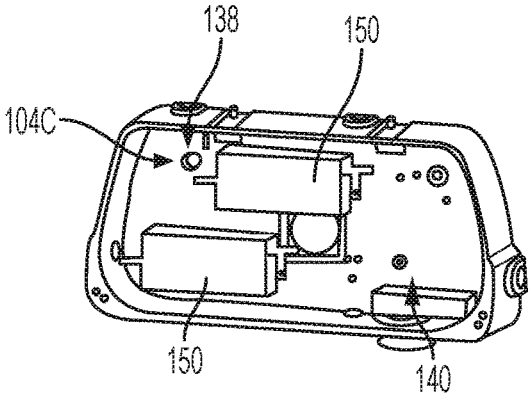
FIG. 26 is a front perspective view of a third exemplary control assembly positioned in the housing.
Figure 27:
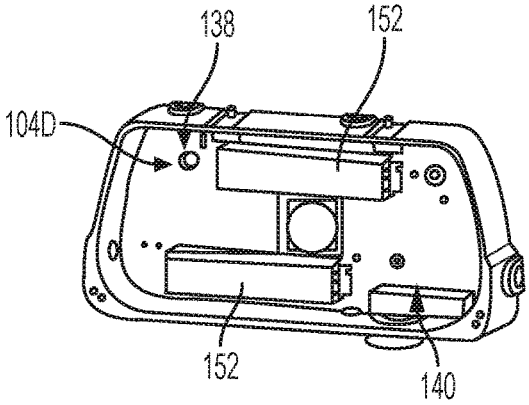
FIG. 27 is a front perspective view of a fourth exemplary control assembly positioned in the housing.

FIGS. 26 and 27 show exemplary control assemblies 104C-D that utilize dual drivers. FIG. 26 shows a pair of second drivers 150 that run at approximately 700 mA each. FIG. 27 shows a pair of third drivers 152 that runs at approximately 525 mA each. The second and third drivers 150, 152 are positioned so that a major surface is substantially parallel to the back wall of the housing 102. Different components and combinations of components can be used in different control assemblies, including different drivers, surge protectors, sensors, and/or wireless communication devices as required for different applications.

Figure 28:
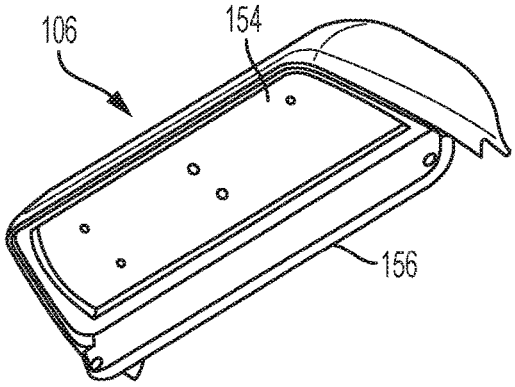
FIG. 28 is a bottom perspective view of an exemplary cover.
Figure 29:
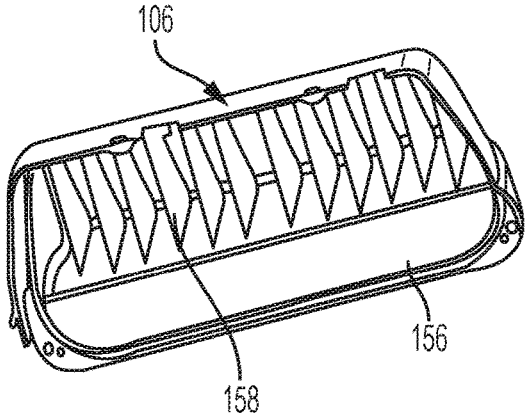
FIG. 29 is a rear perspective view of FIG. 28.
Figure 30:
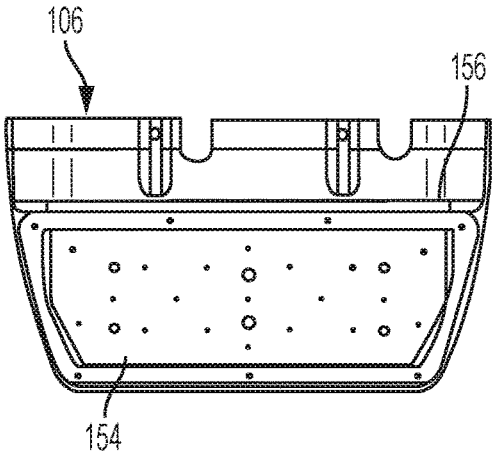
FIG. 30 is a bottom view of FIG. 28.
Figure 31:
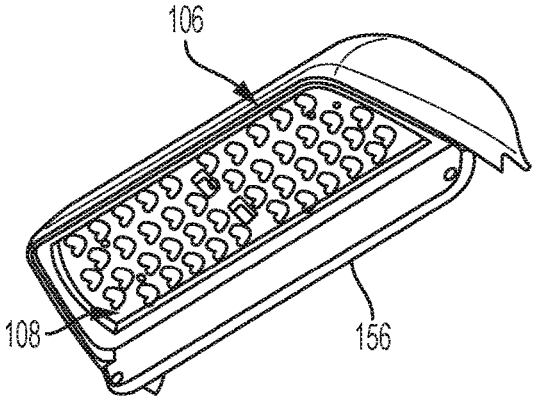
FIG. 31 is a bottom perspective view of the exemplary cover and an exemplary light assembly.
Figure 32:
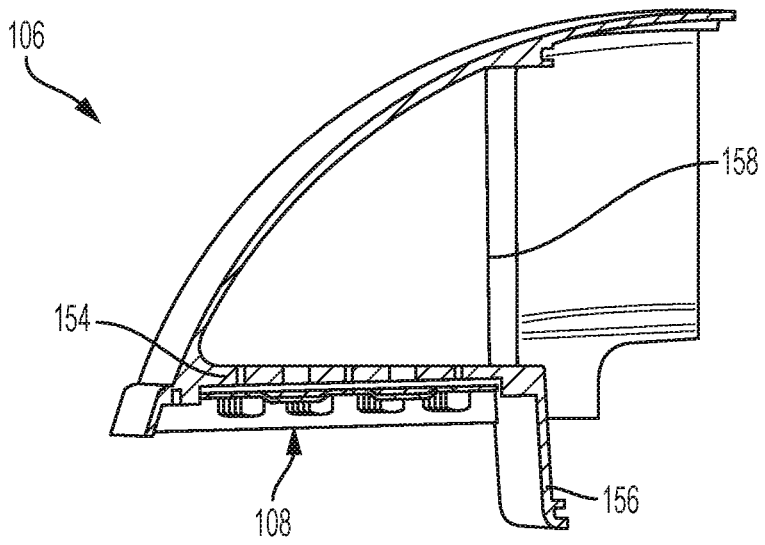
FIG. 32 is a side perspective, cross-sectional view of FIG. 31.
Figure 33:
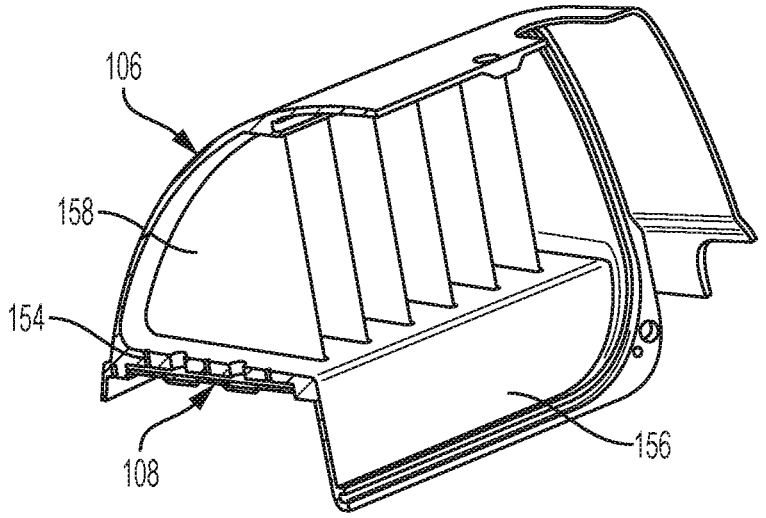
FIG. 33 is a rear perspective, cross-sectional view of FIG. 31.

FIGS. 28-30 show an exemplary cover 106. The cover 106 includes a curved top edge, rounded corners, and angled sides that enclose a chamber. The cover 106 also includes a mounting section 154 for receiving at least a portion of the light assembly 108. One or more openings can extend through the mounting section 154 to receive fasteners. Openings can also be provided to increase heat transfer from the light assembly 108. In an exemplary embodiment, the mounting section 154 is recessed to receive the light assembly 108. The cover 106 can also include a mounting flange 156 to assist in connecting the cover 106 to the housing 102. The chamber includes a plurality of fins 158 to transfer heat from the light assembly 108. In an exemplary embodiment, the fins 158 are aligned with rows of light emitters. FIGS. 31-33 show an exemplary embodiment of a light assembly 108 connected to the cover 106.

Figure 34:
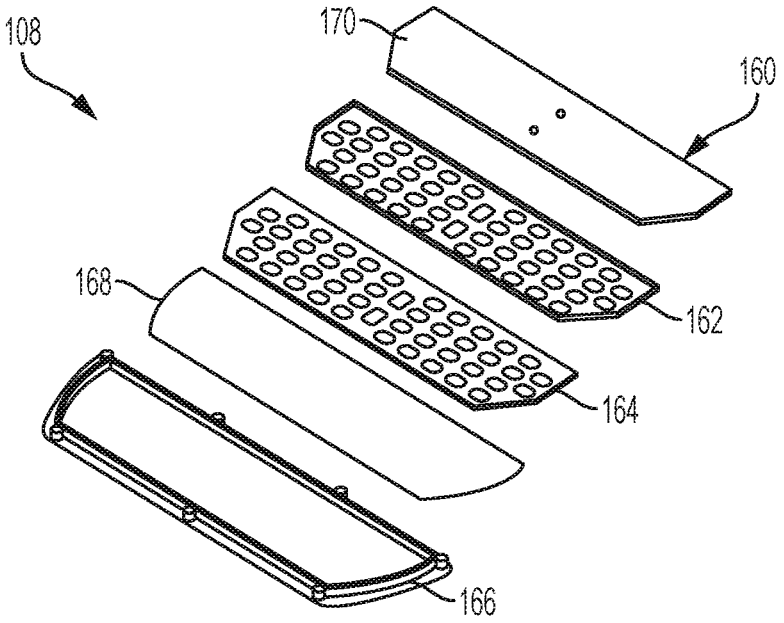
FIG. 34 is a top perspective, exploded view of an exemplary light assembly.
Figure 35:
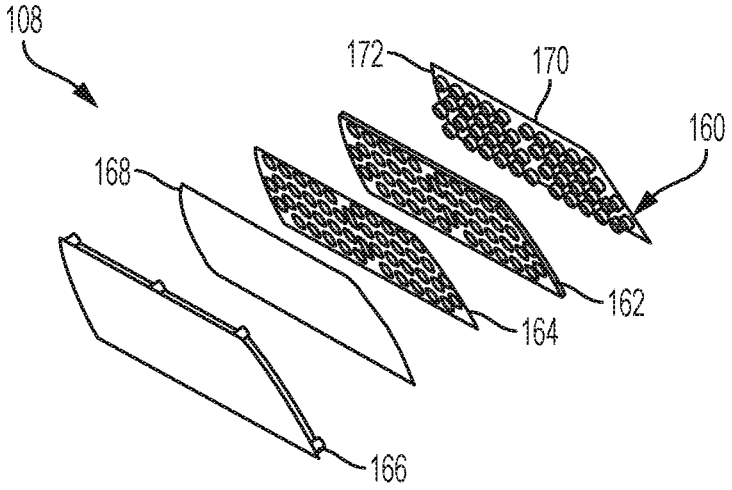
FIG. 35 is a bottom perspective view of FIG. 34.

FIGS. 34 and 35 show an exemplary embodiment of a light assembly 108 that includes an LED board 160, an LED board gasket 162, a bezel 164, a lens 166, and a lens gasket 168. The LED board 160 includes a printed circuit board (PCB) 170 and one or more light emitting devices, for example LEDs, connected to the PCB. One or more optics 172 can be connected to the PCB 170 over the LEDs to direct or diffuse the emitted light. The LED board gasket 162 is positioned between the LED board 160 and the bezel 164 to seal and protect the LED board 160. The LED board gasket 162 can be made from a polymer or elastomer material, for example silicone, although other materials may be used. The bezel 164 can be made from a metal, although other materials may also be used. The lens 166 and lens gasket 168 can be connected to the LED board 160 or the bezel 164. The lens 166 is an optional component that can be connected depending on the desired use. The lens 166 can be colored and/or include light directing or diffusing elements such as prisms.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a base;

a light support extending from the base having a mounting section;

a first set of fins in thermal communication with the mounting section; and a second set of fins intersecting the first set of fins and in thermal communication with the mounting section.

2. The luminaire of claim 1, wherein the first and second set of fins are in contact with the mounting section and are configured to dissipate heat from an LED board connected to the mounting section.

3. The luminaire of claim 1, wherein the second set of fins is substantially orthogonal to the first set of fins.

4. The luminaire of claim 1, wherein the first set of fins includes a first section, a second section, and a third section, and an upper edge of the second section is spaced below an upper edge of the first and third sections.

5. The luminaire of claim 1, wherein at least one of the first set of fins extends beyond the mounting section.

6. The luminaire of claim 5, wherein at least one of the second set of fins extends beyond the mounting section.

7. The luminaire of claim 1, wherein a plurality of gaps are positioned between the base and the light support.

8. The luminaire of claim 1, wherein a control assembly is positioned in the base.

9. The luminaire of claim 1, wherein a cover is connected to the base.

10. The luminaire of claim 9, wherein the cover encloses the first set of fins and the second set of fins.

11. The luminaire of claim 9, wherein the cover includes a third set of fins extending from an inside of the cover toward the base.

12. A luminaire comprising:

a housing;

a control assembly positioned in the housing;

a cover connected to the housing having a mounting section and a chamber including a heat fin in thermal communication with the mounting section; and a light assembly connected to the mounting section and operatively connected to the control assembly.

13. The luminaire of claim 12, wherein the housing includes a conductor opening.

14. The luminaire of claim 13, wherein a recessed is formed around the conductor opening and a conductor gasket is positioned in recess.

15. The luminaire of claim 12, wherein the control assembly includes a photo sensor and an occupancy sensor.

16. The luminaire of claim 12, wherein the control assembly includes a driver.

17. The luminaire of claim 12, wherein the control assembly includes a first driver and a second driver.

18. The luminaire of claim 12, wherein the cover includes a mounting flange.

19. The luminaire of claim 12, wherein the cover includes a top edge extending over the housing.

20. The luminaire of claim 12, wherein the mounting portion is recessed.

* * * * *